US009795852B2

(12) United States Patent
Shew et al.

(10) Patent No.: US 9,795,852 B2
(45) **Date of Patent: *Oct. 24, 2017**

(54) GOLF SWING WRIST CONDITION TRAINING DEVICE

(71) Applicant: Kyron, LLC, San Clemente, CA (US)

(72) Inventors: Robert Scott Shew, San Clemente, CA (US); Lance Gordon Hussey, Thousand Oaks, CA (US); Ravi Kumar Sawhney, Thousand Oaks, CA (US)

(73) Assignee: Kyron, LLC, San Clemente, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/814,325

(22) Filed: Jul. 30, 2015

(65) Prior Publication Data

US 2015/0335976 A1 Nov. 26, 2015

Related U.S. Application Data

(63) Continuation-in-part of application No. 13/237,705, filed on Sep. 20, 2011, now Pat. No. 9,095,758.

(60) Provisional application No. 61/384,614, filed on Sep. 20, 2010.

(51) Int. Cl.

| | |
|---|---|
| ***A63B 69/36*** | (2006.01) |
| ***A63B 69/00*** | (2006.01) |
| ***A63B 71/06*** | (2006.01) |

(52) U.S. Cl.

CPC ..... *A63B 69/0059* (2013.01); *A63B 69/3608* (2013.01); *A63B 2071/0633* (2013.01); *A63B 2209/023* (2013.01); *A63B 2209/10* (2013.01); *A63B 2225/09* (2013.01)

(58) Field of Classification Search

CPC . A63B 69/36; A63B 69/3608; A63B 69/0059; A63B 2071/0633; A63B 2209/10; A63B 2209/023; A63B 2225/09

USPC ..... 473/207, 212, 213

See application file for complete search history.

(56) References Cited

U.S. PATENT DOCUMENTS

| | | | |
|---|---|---|---|
| 3,400,934 | A | 9/1968 | Muehl |
| 4,017,086 | A | 4/1977 | Washburn |
| 4,088,318 | A | 5/1978 | Massman |
| 5,048,837 | A | 9/1991 | Manley et al. |
| 5,511,788 | A | 4/1996 | Manley et al. |

(Continued)

*Primary Examiner* — Raleigh W Chiu

(74) *Attorney, Agent, or Firm* — Stetina Brunda Garred and Brucker; Mark B. Garred

(57) ABSTRACT

In accordance with the present invention, there is provided various embodiments of a golf swing training device which is uniquely configured to maintain a desirable bent wrist condition through the entirety of the downswing (including golf ball impact) and follow-though or finish of the golf swing. More particularly, the training device constructed in accordance with the present invention allows the wearer/user to start the golf swing with the right wrist in its natural, generally flattened condition at address. Once the backswing of the golf stroke is initiated, the training device of the present invention allows the wearer/user to bend the right wrist back naturally, and at different amounts so as to represent the different amounts of right wrist bend a golfer may employ for shorter and longer strokes. Once the right wrist has achieved its full amount of bend at the time of the downswing, the training device constructed in accordance with the present invention effectively maintains such bend throughout the entirety of the downswing and follow-through or finish of the golf swing.

20 Claims, 12 Drawing Sheets

(56) References Cited

U.S. PATENT DOCUMENTS

| | | | |
|---|---|---|---|
| 5,527,040 | A | 6/1996 | Stanley et al. |
| 5,827,126 | A | 10/1998 | Lee |
| 5,868,632 | A | 2/1999 | Drelick |
| 7,789,763 | B1 | 9/2010 | Smith |
| 2012/0071256 | A1 | 3/2012 | Shew et al. |
| 2012/0190470 | A1 | 7/2012 | Sanati |

GOLF SWING WRIST CONDITION TRAINING DEVICE

CROSS-REFERENCE TO RELATED APPLICATIONS

The present application is a continuation-in-part of U.S. application Ser. No. 13/237,705 entitled GOLF SWING WRIST CONDITION TRAINING DEVICE filed Sep. 20, 2011, which claims priority to U.S. Provisional Patent Application Ser. No. 61/384,614 entitled GOLF SWING WRIST CONDITION TRAINING DEVICE filed Sep. 20, 2010, the disclosure of which is incorporated herein by reference.

STATEMENT RE: FEDERALLY SPONSORED RESEARCH/DEVELOPMENT

Not Applicable

BACKGROUND OF THE INVENTION

1. Technical Field of the Invention

The present invention relates generally to the game of golf and, more particularly, to a golf swing training device which is uniquely configured to maintain a desirable bent wrist condition through the entirety of the downswing (including golf ball impact) and follow-though or finish of the golf swing.

2. Description of the Related Art

In the game of golf, in order to control the golf ball, one must control the instrument (i.e., the golf club). The golf club consists of three primary components, which are the club head, the club shaft, and the club face. One of the biggest, if not the biggest problem, golfers battle in trying to develop and maintain an effective golf swing is the unnecessary and tremendously destructive flattening of the right wrist (in the case of a right-handed golfer) prior to or during the impact of the club face on the golf ball and separation of the ball therefrom. The stifling effects of a flattening right wrist of a right handed golfer during the downswing includes the loss of control of all three of the aforementioned components of the golf club, thereby resulting in a loss of distance and direction of the golf ball. More particularly, club head lag and the circular orbit of the club head (power), club face alignment (direction), and the club shaft plane (direction) are all destroyed by the flattening right wrist.

In order to incorporate right wrist flattening for a right handed golfer into a golf stroke procedure with any kind of reliability, one would need to trigger the flattening of the right wrist at the same point, flatten it at the same rate, and flatten it by the same amount. This, however, gives rise to a virtually insurmountable timing challenge that golfers struggle with and thus prevents consistency in the golf swing. A far superior procedure would be to completely omit the act of right wrist flattening from the stroke pattern. Since, in a sense, the moment of impact of the club face against the golf ball is golf's moment of truth as a result of the data transfer from the golf club to the ball which occurs at this moment, the ability to keep the right wrist in its bent condition as achieved at the top of the backswing is one of the major factors separating successful golfers from poor golfers. Along these lines, since one of the primary principles of the game and of a successful and effective golf swing is to create and sustain a line of compression, the undesirable right wrist flattening and its associated lag loss will account for the exact opposite effect, i.e., compression leakage.

There is currently known in the prior art certain golf swing training products which are adapted to prevent a flattening right wrist in a right handed golfer. However, these currently known products possess certain deficiencies which detract from their overall utility. More particularly, such existing products are configured to impart to the wearer/user a fixed, exact amount of wrist bend at the start position of the golf swing (i.e., at address). However, the full amount of wrist bend in the right wrist is typically not achieved by a player until the top of the backswing has been reached. In this regard, for most players, the natural condition of the right wrist at the starting position or address is generally flat, with the right wrist achieving a fully bent condition at the top of the backswing, and optimally maintaining such bent condition through the completion of the downswing (including impact) and follow-through. Since currently known wrist condition training devices fix the right wrist with a prescribed amount of bend at the outset, the wearer/user is unable to assume a normal, generally flat right wrist condition at address, and is further unable to bend the right wrist back naturally during the golf stroke, and in particular the backswing.

The present invention addresses and overcomes the deficiencies highlighted above by providing a golf swing training device which is uniquely configured to allow varying levels or degrees of right wrist bend during the backswing of the golf stroke, and to preserve the amount of right wrist bend achieved at the top of the backswing through the entire downswing of the wearer/user (including the point of impact between the club face and the golf ball), as well as the follow-through/finish of the golf swing. These, as well as other features and advantages of the present invention, will be described in more detail below.

BRIEF SUMMARY OF THE INVENTION

In accordance with the present invention, there is provided various embodiments of a golf swing training device which is uniquely configured to maintain a desirable bent wrist condition through the entirety of the downswing (including golf ball impact) and follow-though or finish of the golf swing. More particularly, the training device constructed in accordance with the present invention allows the wearer/user to start the golf swing with the right wrist in its natural, generally flattened or slightly bent condition at address. Once the backswing of the golf stroke is initiated, the training device of the present invention allows the wearer/user to bend the right wrist back naturally, and at different amounts so as to represent the different amounts of right wrist bend a golfer may employ for shorter and longer strokes. Once the right wrist has achieved its full amount of bend at the top of the backswing, the training device constructed in accordance with the present invention effectively maintains such bend throughout the entirety of the downswing and follow-through or finish of the golf swing.

The present invention is best understood by reference to the following detailed description when read in conjunction with the accompanying drawings.

BRIEF DESCRIPTION OF THE DRAWINGS

These, as well as other features of the present invention, will become more apparent upon reference to the drawings wherein.

Common reference numerals are used throughout the drawings and detailed description to indicate like elements.

DETAILED DESCRIPTION OF THE INVENTION

Figure 1:
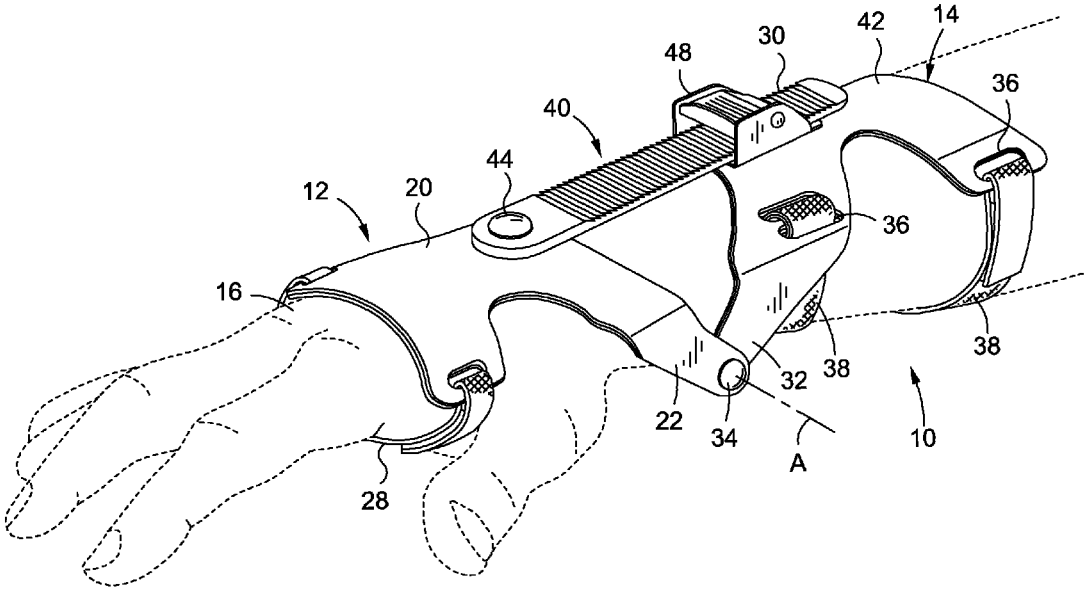
FIG. 1 is a top perspective view of a golf swing training device constructed in accordance with a first embodiment of the present invention, the training device being shown in a first, flat state or condition.

Referring now to the drawings wherein the showings are for purposes of illustrating preferred embodiments of the present invention only, and not for purposes of limiting the same, FIGS. 1-4 depict a golf swing training device 10 constructed in accordance with a first embodiment of the present invention. The training device 10 of the first embodiment as will be described below, as well as those training devices constructed in accordance with other embodiments of the present invention as also described below, will each be discussed in terms of use by a right handed golfer, and thus configured for interface to the right arm of the wearer or user thereof. However, those of ordinary skill in the art will recognize that for a left-handed golfer, the structural and functional attributes of the training device 10 and those other embodiments described below would be substantially identical to but presented as a mirror image of those versions particularly suited to a right-handed golfer. Along these lines, it is contemplated that the modification of the training device 10 or any of the other embodiments thereof as discussed below to accommodate a left-handed golfer is within the spirit and scope of the present invention.

Figure 2:
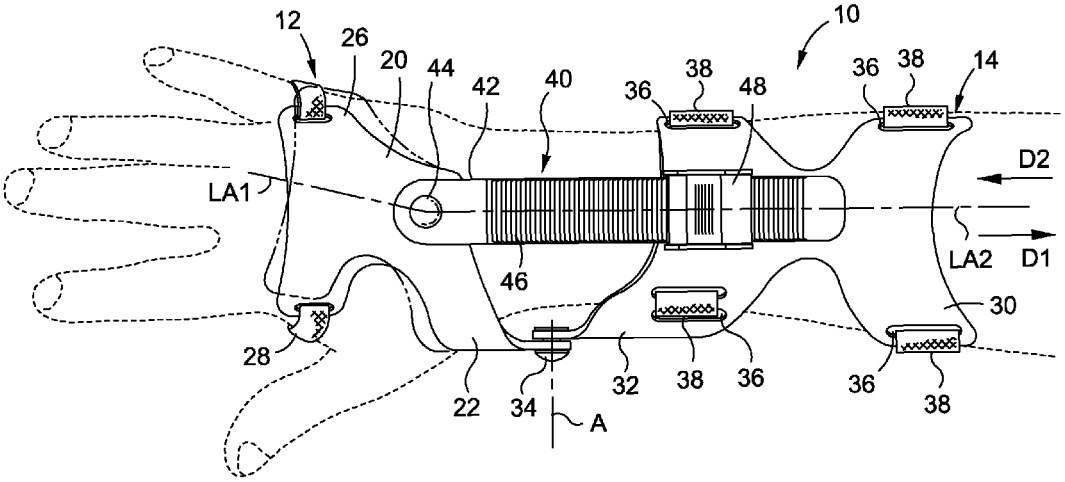
FIG. 2 is a top plan view of the training device of the first embodiment shown in FIG. 1.
Figure 3:
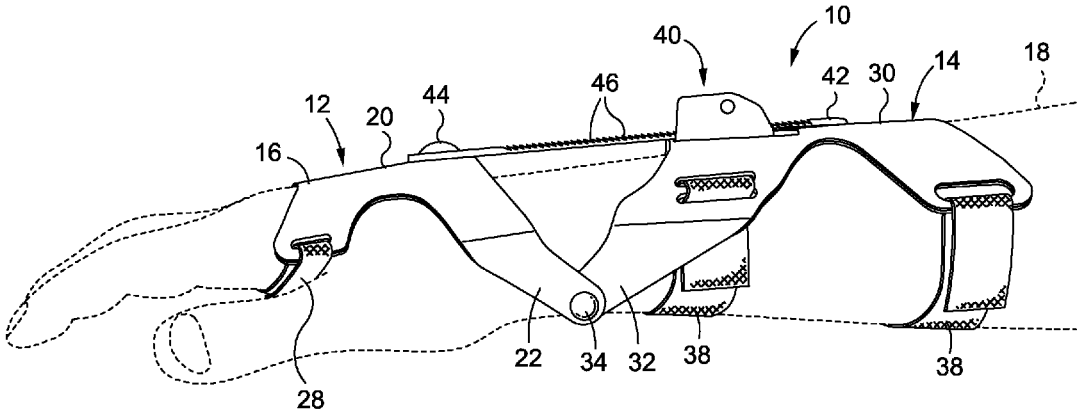
FIG. 3 is a side-elevational view of the training device of the first embodiment shown in FIG. 1 as operatively positioned on the right arm of a user, the training device being shown in the flat condition.
Figure 4:
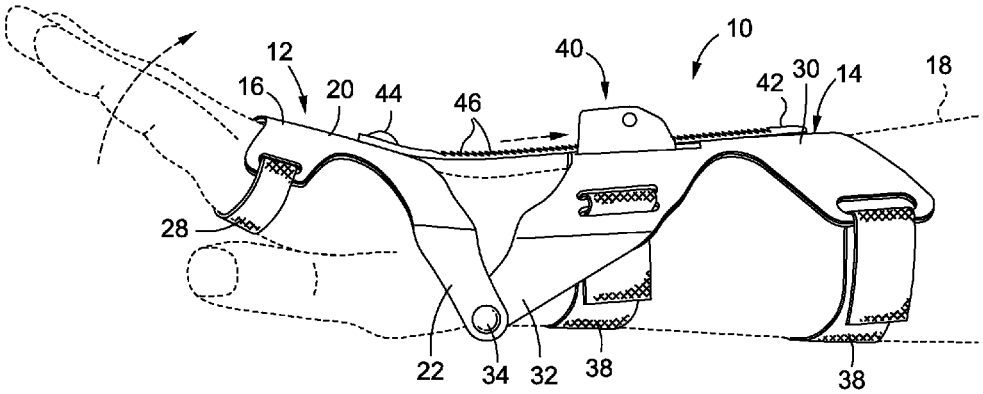
FIG. 4 is a side-elevational view of the training device of the first embodiment shown in FIG. 1 which is similar to FIG. 3, but depicts the training device in a second, "bent" condition.

The training device 10 of the first embodiment comprises a hand plate 12 and a forearm plate 14 which are pivotally connected to each other. As will be discussed in more detail below, the pivotal connection of the hand and forearm plates 12, 14 to each other is adapted to facilitate the selective pivotal movement of the hand plate 12 relative to the forearm plate 14 about an axis A which is shown and labeled in FIGS. 1 and 2. As best seen in FIGS. 3 and 4, the hand plate 12 of the training device 10 is configured to be positionable upon the posterior surface of the right hand 16 of the user, the posterior surface of the right hand 16 being that surface which is opposite the anterior or palmer surface of the right hand 16. The forearm plate 14 is itself adapted to be positionable upon the posterior surface of the right forearm 18 of the user. In this regard, both the hand plate 12 and forearm plate 14, when operatively positioned upon the right arm of the user, are each adapted to terminate at approximately the right wrist of the user, with the relative orientations of the hand and forearm plates 12, 14 being such that the axis A defined by the point of pivotal connection therebetween extends approximately through the center of the user's right wrist, and hence the hinge point defined thereby.

In the training device 10, the hand plate 12 includes a main body portion 20 which is adapted to rest on the posterior surface of the right hand 16 of the user, and an arcuate prong portion 22 which, from the perspective shown in FIG. 1, is integrally connected to one side of the main body portion 20 and protrudes downwardly therefrom. In this regard, when the main body portion 20 is positioned on the posterior surface of the right hand 16 of the user, the prong portion 22 is adapted to extend along the inner side of the user's wrist in the manner best shown in FIGS. 3 and 4. As further seen in FIG. 2, disposed within the main body portion 20 of the hand plate 12 is a pair of elongate slots 24 which extend in spaced, generally parallel relation to each other. The use of the slots 24 will be described in more detail below.

In addition to the slots 24, the main body portion 20 of the hand plate 12 includes an opposed pair of slots or apertures 26 formed therein. The apertures 26 are used to facilitate the attachment of respective ones of the opposed end portions of an elongate retention strap 28 of the training device 10 to the hand plate 12. As most easily seen in FIGS. 3 and 4, the retention strap 28 is extensible about the anterior or palmer surface of the right hand 16 of the user and, when tightened, is operative to maintain the main body portion 20 of the hand plate 12 in firm, abutting contact with the posterior surface of the right hand 16. Those of ordinary skill in the art will recognize that modalities other than for the retention strap 28 may be used for maintaining firm, abutting contact between the main body portion 20 of the hand plate 12 and the posterior surface of the right hand 16 of the user. By way of example, it is contemplated that the main body portion 20 of the hand plate 12 may be outfitted with one or more ring-like projections which are extensible about one or more of the index, middle and ring fingers of the right hand of the wearer.

The forearm plate 14 of the training device 10 comprises a main body portion 30 which, as best seen in FIGS. 3 and 4, is adapted to be positionable upon the posterior surface of the right forearm 18 of the user. In addition to the main body portion 30, the forearm plate 14 includes an arcuate prong portion 32 which is integrally connected to the main body portion 30 and, from the perspective shown in FIG. 1, extends downwardly from one side of the main body portion 30. More particularly, as seen in FIGS. 3 and 4, the prong portion 32, like the prong portion 22 of the hand plate 12, is adapted to extend along the inner surface of the right wrist of the user when the training device 10 is operatively positioned on the right arm of the user. In the training device 10, distal regions of the prong portions 22, 32 are pivotally connected to each other through the use of a pivot pin 34 to facilitate the pivotal or rotatable connection of the hand and forearm plates 12, 14 to each other, the pivot pin 34 thus defining the aforementioned axis A. Those of ordinary skill in the art will recognize that the use of a pivot pin 34 to facilitate the pivotal connection of the hand and forearm plates 12, 14 to each other is exemplary only, and that numerous other mechanical structures may be used to facilitate such connection without departing from the spirit and scope of the present invention.

Similar to the hand plate 12, the forearm plate 14 is preferably formed to define two opposed pairs of slots or apertures 36 therein. In this regard, the apertures 36 of each of pair are disposed adjacent to and extend along respective ones of an opposed pair of longitudinally extending peripheral edge segments defined by the main body portion 30. The apertures 36 of each opposed pair are used to facilitate the interface or engagement of respective ones of a pair of elongate retention straps 38 to the forearm plate 14. As also seen in FIGS. 3 and 4, the retention straps 38 are sized and configured to be extensible about the right forearm 18 of the user such that, when properly tightened, they function to maintain the main body portion 30 of the forearm plate 14 in firm, abutting contact with the posterior surface of the right forearm 18. Those of ordinary skill in the art will recognize that the use of the retention straps 38 as a modality to maintain the firm engagement between the forearm plate 14 and the right forearm 18 of the user is exemplary only, and that the use of alternative structures to facilitate such engagement is contemplated to be within the spirit and scope of the present invention. By way of example and not by way of limitation, it is contemplated that the forearm plate 14 may be outfitted with, or at least partially integrated into, an elastic, sleeve-like structure which is extensible over and frictionally engageable to the right forearm 16 of the user.

The training device 10 of the first embodiment further comprises a wrist condition retention assembly 40 which is attached to and effectively interconnects the hand and forearm plates 12, 14 to each other. The retention assembly 40 comprises an elongate ratchet strap 42, one end of which is attached to the main body portion 20 of the hand plate 12. More particularly, as best seen in FIG. 2, the attachment of one end of the ratchet strap 42 to the hand plate 12 is facilitated by the advancement of a fastener 44 through an end portion of the ratchet strap 42 and into one of the slots 24 formed within the main body portion 20. In this regard, the selection of that slot 24 of the pair into which the fastener 44 is advanced and the point along such slot 24 at which the fastener 44 is ultimately secured allows for a certain measure of variability in the particular attachment location of the ratchet strap 42 to hand plate 12. As is most apparent from FIG. 2, the ratchet strap 42 is formed to include a multiplicity of serrations or teeth 46 along the majority of the length thereof.

In addition to the ratchet strap 42, the retention assembly 40 includes a locking mechanism 48 which is attached to the main body portion 30 of the forearm plate 14 and releasably engageable to the ratchet strap 42. As seen in FIGS. 1-4, the ratchet strap 42 is advanceable through the locking mechanism 48. When viewed from the perspective shown in FIG. 2, the locking mechanism 48 allows for the free passage and movement of the ratchet strap 42 therethrough in the direction shown by the arrow D1, but normally prevents the movement of the ratchet strap 42 therethrough in the direction shown by the arrow D2 which is opposite the direction D1. In this regard, in the retention assembly 40, the movement of the ratchet strap 42 in the direction D2 is normally prevented by the engagement of the locking mechanism 48 to a corresponding one of the teeth 46 defined by the ratchet strap 42. However, the movement of the ratchet strap 42 in the direction D2 is made possible by the application of compressive pressure to a prescribed, spring biased portion of the locking mechanism 48, such application of compressive pressure causing the locking mechanism 48 to effectively disengage the teeth 46 of the ratchet strap 42 as permits movement in the direction D2. However, once the application of compressive pressure thereto is discontinued, the locking mechanism 48 effectively re-engages at least one the teeth 46 of the ratchet strap 42 in a manner again preventing movement thereof in the direction D2. Those of ordinary skill in the art will recognize that the structural and functional attributes of the retention assembly 40 mirror, in large measure, the structural and functional attributes of ratcheting retention systems included on devices such as ski boot and snowboard boot bindings.

Having thus described the structural features of the training device 10 constructed in accordance with the first embodiment of the present invention, one exemplary manner of using the same will now be described with specific reference to FIGS. 3 and 4. In use of the training device 10, it is contemplated that such training device 10 will assume a first, generally flat or slightly bent state or condition as shown in FIG. 3 when the user addresses the golf ball and is ready to initiate the golf swing. Whereas the right wrist of the user is capable of moving from a flat condition to a state of extension since the ratchet strap 42 is free to move in the direction D1, the training device 10 normally prevents the right wrist of the user from moving to a state of flexion. More particularly, the movement of the right wrist to a flexed condition is prevented by the retention assembly 40, and in particular the engagement of the locking mechanism 48 to the ratchet strap 42 which prevents movement of the ratchet strap 42 in the direction D2 as would be needed to allow the right wrist of the user to be transitioned from the flat condition shown in FIG. 3 to such flexed condition. Conversely, since the retention assembly 40 normally allows movement of the ratchet strap 42 in the direction D1, the right wrist of the user is capable of transitioning from the flat condition shown in FIG. 3 to an extended condition as shown in FIG. 4. However, once the right wrist of the user reaches any state of extension such as that shown in FIG. 4, any movement of the right wrist back toward the flattened state is prevented by the retention assembly 40, and in particular the engagement of the locking mechanism 48 to a corresponding one of the teeth 46 of the ratchet strap 42.

As indicated above, when the user addresses the golf ball and is about to initiate golf swing, the right wrist will typically be in the generally flat or slightly bent state or condition shown in FIG. 3. As the user begins the back swing, the training device 10 permits the movement of the user's right wrist to any one of a multiplicity of differing degrees of extension, with the level of maximum extension or bend of the right wrist typically occurring at the top of the backswing. The level of extension or bend in the right wrist at the top of the backswing typically represents the bent right wrist condition which should be maintained through the entirety of the downswing, golf ball impact, and follow-through of the golf swing. As previously explained, the interaction between the locking mechanism 48 and ratchet strap 42 of the retention assembly 40 effectively maintains the state of extension or the bent wrist condition of the right wrist of the user at the top of the backswing, and prevents the right wrist from any movement back toward a flattened state or condition until such time as the locking mechanism 48 is manipulated in the aforementioned manner by the application of compressive pressure to a portion thereof. Along these lines, after the completion of a golf swing while wearing the training device 10, the user will "reset" the device 10 by manipulating the locking mechanism 48 in a manner which allows the right wrist to be returned to the original flat condition.

As is most apparent from FIG. 2, when the hand and forearm plates 12, 14 of the training device 10 are in the flat condition, the longitudinal axis LA1 defined by the hand plate 12 is not linearly aligned with the longitudinal axis LA2 defined by the forearm plate 14. Rather, the longitudinal axis LA1 of the hand plate 12 is slightly offset from the longitudinal axis LA2. This slight angular offset between the longitudinal axes LA1, LA2 promotes greater comfort to the user of the training device 10 and efficacy in the functionality thereof. It is also contemplated that the hand and forearm plates 12, 14 may be fabricated from various materials (e.g., metals, plastics, etc.) in any combination. However, one preferred material for the hand and forearm plates 12, 14 is a carbon fiber composite or laminate which is both lightweight and durable. Irrespective of the material(s) used for the hand and forearm plates 12, 14, it is also contemplated that those surfaces thereof coming into direct contact with the right hand 16 and right forearm 18 of the user may have a suitable padded or cushioning layer applied thereto for greater wearer comfort.

Figure 8:
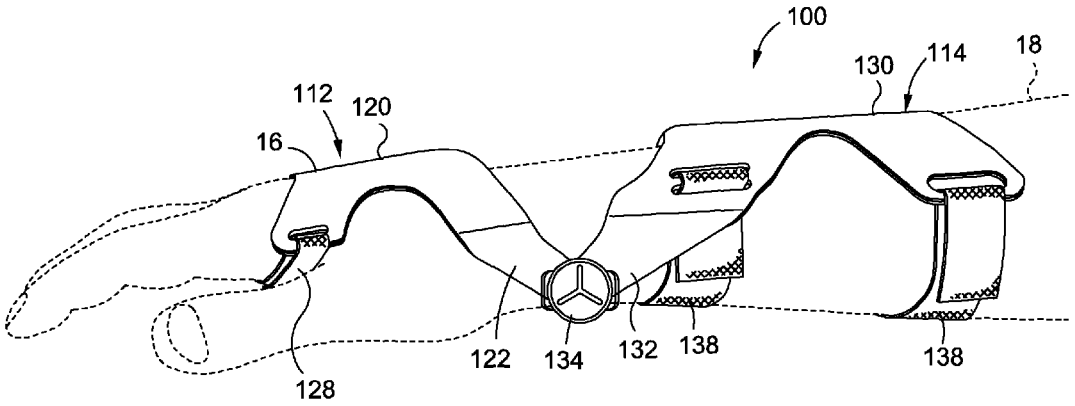
FIG. 8 is a side-elevational view of the training device of the second embodiment as operatively positioned on the right arm of a user, depicting the training device in its flat condition shown in FIGS. 5 and 6.
Figure 9:
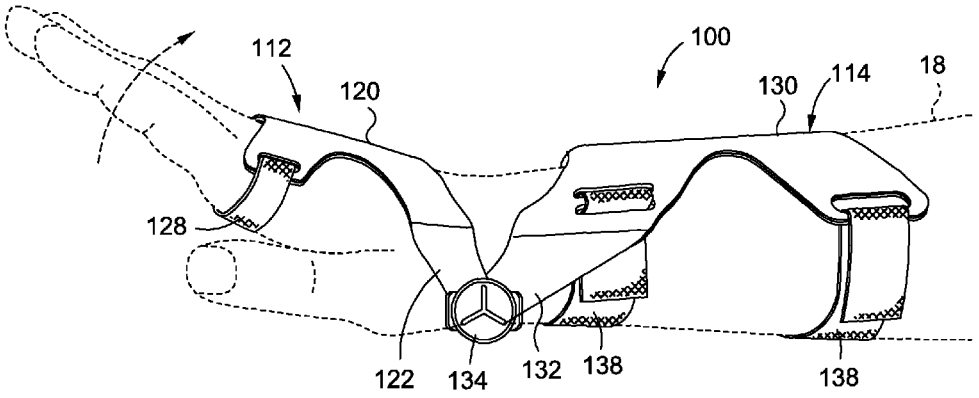
FIG. 9 is a side-elevational view of the training device of the second embodiment similar to FIG. 8, but depicting the training device in its bent condition as shown in FIG. 7.
Figure 10:
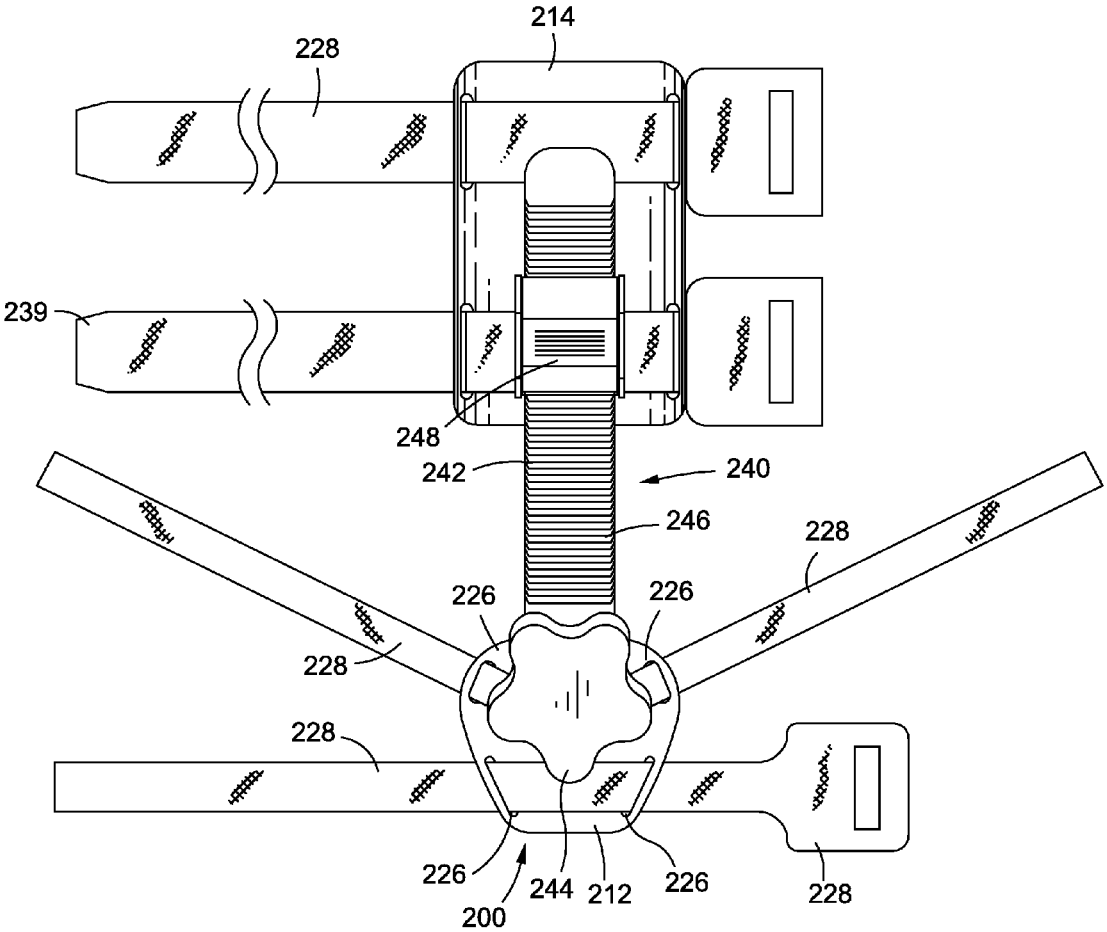
FIG. 10 is a top plan view of a golf swing training device constructed in accordance with a third embodiment of the present invention.

Referring now to FIGS. 5-9, there is shown a golf swing training device 100 constructed in accordance with a second embodiment of the present invention. The training device 100 of the second embodiment comprises a hand plate 112 and a forearm plate 114 which are pivotally connected to each other. As will be discussed in more detail below, the pivotal connection of the hand and forearm plates 112, 114 to each other is adapted to facilitate the selective pivotal movement of the hand plate 112 relative to the forearm plate 114 about an axis A which is shown and labeled in FIGS. 5 and 7. As best seen in FIGS. 8 and 9, the hand plate 112 of the training device 100 is configured to be positionable upon the posterior surface of the right hand 16 of the user, the posterior surface of the right hand 16 being that surface which is opposite the anterior or palmer surface of the right hand 16. The forearm plate 114 is itself adapted to be positionable upon the posterior surface of the right forearm 18 of the user. In this regard, both the hand plate 112 and forearm plate 114, when operatively positioned upon the right arm of the user, are each adapted to terminate at approximately the right wrist of the user, with the relative orientations of the hand and forearm plates 112, 114 being such that the axis A defined by the point of pivotal connection therebetween extends approximately through the center of the user's right wrist, and hence the hinge point defined thereby.

Figure 5:
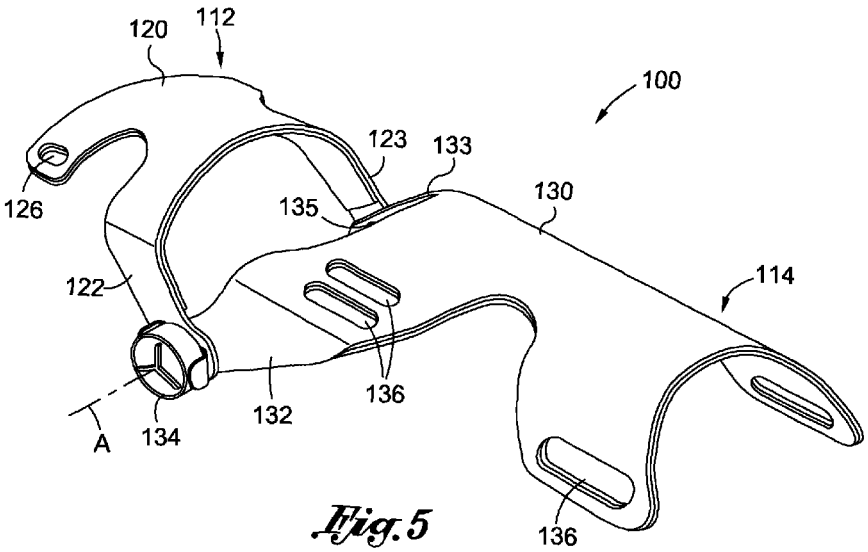
FIGS. 5 and 6 are top perspective views of a golf swing training device constructed in accordance with a second embodiment of the present invention, the training device being shown in a first, flat condition.
Figure 6:
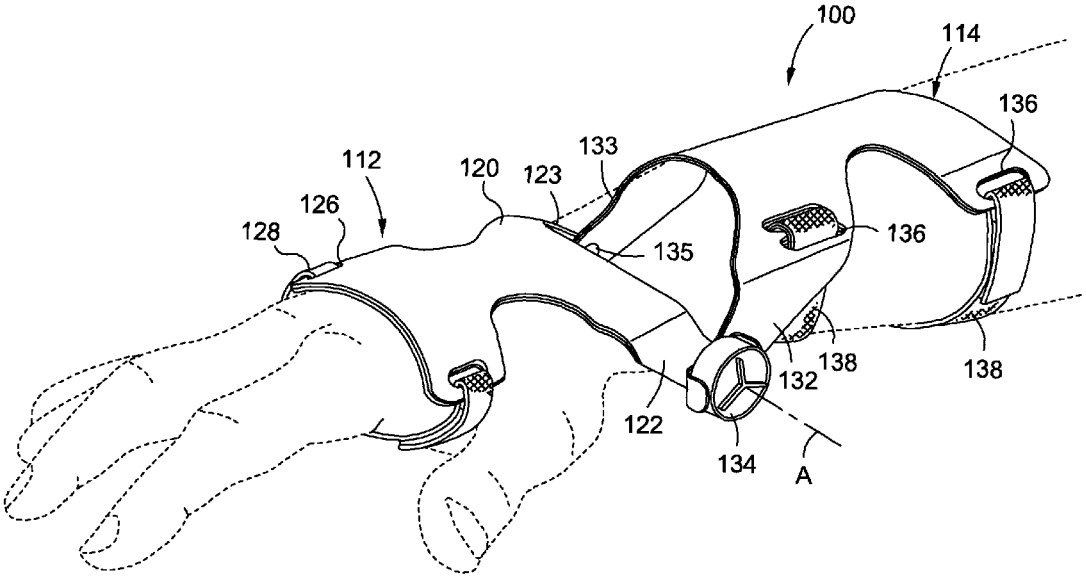
Figure 7:
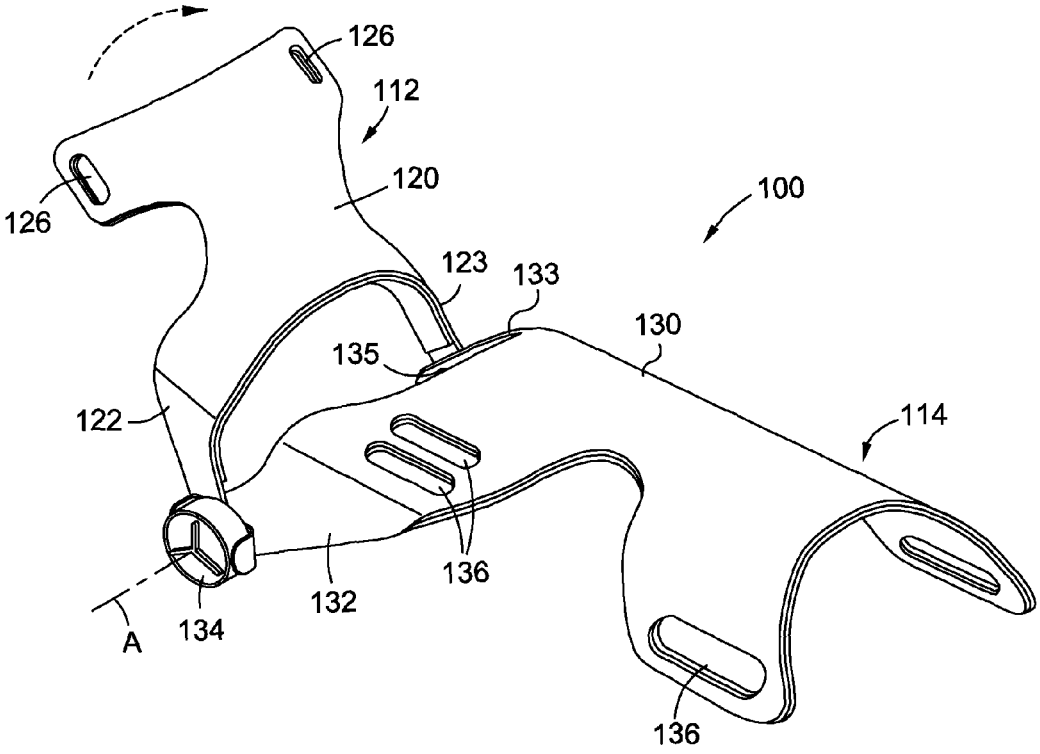
FIG. 7 is a top perspective view of the training device of the second embodiment similar to FIG. 5, but showing the training device in a second, bent condition.

In the training device 100, the hand plate 112 includes a main body portion 120 which is adapted to rest on the posterior surface of the right hand 16 of the user, and an opposed pair of arcuate prong portion 122, 123 which, from the perspective shown in FIG. 5, are integrally connected to respective, opposed sides of the main body portion 120 and protrude downwardly therefrom. In this regard, when the main body portion 120 is positioned on the posterior surface of the right hand 16 of the user, the prong portions 122, 123 are adapted to extend along respective ones of the inner and outer sides of the user's wrist in the manner best shown in FIGS. 8 and 9. As further seen in FIGS. 5-7, disposed within the main body portion 120 of the hand plate 112 is a pair of elongate slots 124 which extend in spaced, generally parallel relation to each other, and are used to provide a weight reduction function.

In addition to the slots 124, the main body portion 120 of the hand plate 112 includes an opposed pair of slots or apertures 126 formed therein. The apertures 126 are used to facilitate the attachment of respective ones of the opposed end portions of an elongate retention strap 128 of the training device 100 to the hand plate 112. As most easily seen in FIGS. 8 and 9, the retention strap 128 is extensible about the anterior or palmer surface of the right hand 16 of the user and, when tightened, is operative to maintain the main body portion 120 of the hand plate 112 in firm, abutting contact with the posterior surface of the right hand 16. Those of ordinary skill in the art will recognize that modalities other than for the retention strap 128 may be used for maintaining firm, abutting contact between the main body portion 120 of the hand plate 112 and the posterior surface of the right hand 16 of the user. By way of example, it is contemplated that the main body portion 120 of the hand plate 112 may be outfitted with one or more ring-like projections which are extensible about one or more of the index, middle and ring fingers of the right hand of the wearer.

The forearm plate 114 of the training device 100 comprises a main body portion 130 which, as best seen in FIGS. 8 and 9, is adapted to be positionable upon the posterior surface of the right forearm 18 of the user. In addition to the main body portion 130, the forearm plate 114 includes an opposed pair of arcuate prong portions 132, 133 which are integrally connected to the main body portion 130 and, from the perspective shown in FIG. 5, extend downwardly from respective sides of the main body portion 130. More particularly, as seen in FIGS. 8 and 9, the prong portion 132, 133, like the prong portion 122, 123 of the hand plate 112, are adapted to extend along respective ones of the inner and outer surfaces of the right wrist of the user when the training device 100 is operatively positioned on the right arm of the user.

In the training device 100, distal regions of the prong portions 122, 132 are pivotally connected to each other through the use of a ratchet mechanism 134, the functional attributes of which will be described in more detail below. Similarly, distal regions of the prong portions 123, 133 are pivotally connected to each other through the use of a pivot pin 135, the ratchet mechanism 134 and pin 135 thus collectively facilitating the pivotal or rotatable connection of the hand and forearm plates 112, 114 to each other, and defining the aforementioned axis A.

Similar to the hand plate 112, the forearm plate 114 is preferably formed to define two opposed pairs of slots or apertures 136 therein. In this regard, the apertures 136 of each of pair are disposed adjacent to and extend along respective ones of an opposed pair of longitudinally extending peripheral edge segments defined by the main body portion 130. The apertures 136 of each opposed pair are used to facilitate the interface or engagement of respective ones of a pair of elongate retention straps 138 to the forearm plate 114. As also seen in FIGS. 8 and 9, the retention straps 138 are sized and configured to be extensible about the right forearm 18 of the user such that, when properly tightened, they function to maintain the main body portion 130 of the forearm plate 114 in firm, abutting contact with the posterior surface of the right forearm 18. Those of ordinary skill in the art will recognize that the use of the retention straps 138 as a modality to maintain the firm engagement between the forearm plate 114 and the right forearm 18 of the user is exemplary only, and that the use of alternative structures to facilitate such engagement is contemplated to be within the spirit and scope of the present invention. By way of example and not by way of limitation, it is contemplated that the forearm plate 114 may be outfitted with, or at least partially integrated into, an elastic, sleeve-like structure which is extensible over and frictionally engageable to the right forearm 16 of the user.

In the training device 100 of the second embodiment, the aforementioned ratchet mechanism 134 effectively functions as a wrist condition retention device. When viewed from the perspective shown in FIGS. 5, 7, 8 and 9, the ratchet mechanism 134 allows for the pivotal or rotatable movement of the hand plate 112 relative to the forearm plate 114 about the axis A in a clockwise direction, but normally prevents the pivotal or rotatable movement of the hand plate 112 relative to the forearm plate 114 about the axis A in a counter-clockwise direction. However, the ratchet mechanism 134 is outfitted with a release switch which, when selectively actuated by the user, allows for the pivotal or rotatable movement of the hand plate 112 relative to the forearm plate about the axis A in a counter-clockwise direction. Those of ordinary skill in the art will recognize that the structural and functional attributes of the ratchet mechanism 134 mirror, in large measure, the structural and functional attributes of conventional ratchet tools.

Having thus described the structural features of the training device 100 constructed in accordance with the second embodiment of the present invention, one exemplary manner of using the same will now be described with specific reference to FIGS. 8 and 9. In use of the training device 100, it is contemplated that such training device 100 will assume a first, generally flat or slightly bent state or condition as shown in FIG. 8 when the user addresses the golf ball and is ready to initiate the golf swing. Whereas the right wrist of the user is capable of moving from a flat condition to a state of extension since the ratchet mechanism 134 (and hence the hand plate 112) is free to rotate in a clockwise direction when viewed from the perspective shown in FIGS. 8 and 9, the ratchet mechanism 134 of the training device 100 also normally prevents the right wrist of the user from moving to a state of flexion. More particularly, the movement of the right wrist to a flexed condition is prevented by the inability of the ratchet mechanism 134 (and hence the hand plate 112) to normally rotate in a counter-clockwise direction when viewed from the perspective shown in FIGS. 8 and 9 as would be needed to allow the right wrist of the user to be transitioned from the flat condition shown in FIG. 8 to such flexed condition. Conversely, since, as indicated above, the ratchet mechanism 134 normally allows rotational movement of the hand plate 112 in a clockwise direction when viewed from the perspective shown in FIGS. 8 and 9, the right wrist of the user is capable of transitioning from the flat condition shown in FIG. 8 to an extended condition as shown in FIG. 9. However, once the right wrist of the user reaches any state of extension such as that shown in FIG. 9, any movement of the right wrist back toward the flattened state is prevented by the ratchet mechanism 134, unless and until the release switch thereof is actuated by the user.

As indicated above, when the user addresses the golf ball and is about to initiate golf swing, the right wrist will typically be in the generally flat or slightly bent state or condition shown in FIG. 8. As the user begins the back swing, the training device 100 permits the movement of the user's right wrist to any one of a multiplicity of differing degrees of extension, with the level of maximum extension or bend of the right wrist typically occurring at the top of the backswing. As indicated above, the level of extension or bend in the right wrist at the top of the backswing typically represents the bent right wrist condition which should be maintained through the entirety of the downswing, golf ball impact, and follow-through of the golf swing. As previously explained, the ratchet mechanism 134 of the training device 100 effectively maintains the state of extension or the bent wrist condition of the right wrist of the user at the top of the backswing, and prevents the right wrist from any movement back toward a flattened state or condition until such time as the release switch of the ratchet mechanism 134 is actuated by the user. Along these lines, after the completion of a golf swing while wearing the training device 100, the user will "reset" the device 100 by manipulating the release switch of the ratchet mechanism 134 in a manner which allows the right wrist to be returned to the original flat condition.

In the training device 100, it is contemplated that the hand and forearm plates 112, 114 may be fabricated from various materials (e.g., metals, plastics, etc.) in any combination. However, one preferred material for the hand and forearm plates 112, 114 is a carbon fiber composite or laminate which is both lightweight and durable. Irrespective of the material(s) used for the hand and forearm plates 112, 114, it is also contemplated that those surfaces thereof coming into direct contact with the right hand 16 and right forearm 18 of the user may have a suitable padded or cushioning layer applied thereto for greater wearer comfort.

Figure 11:
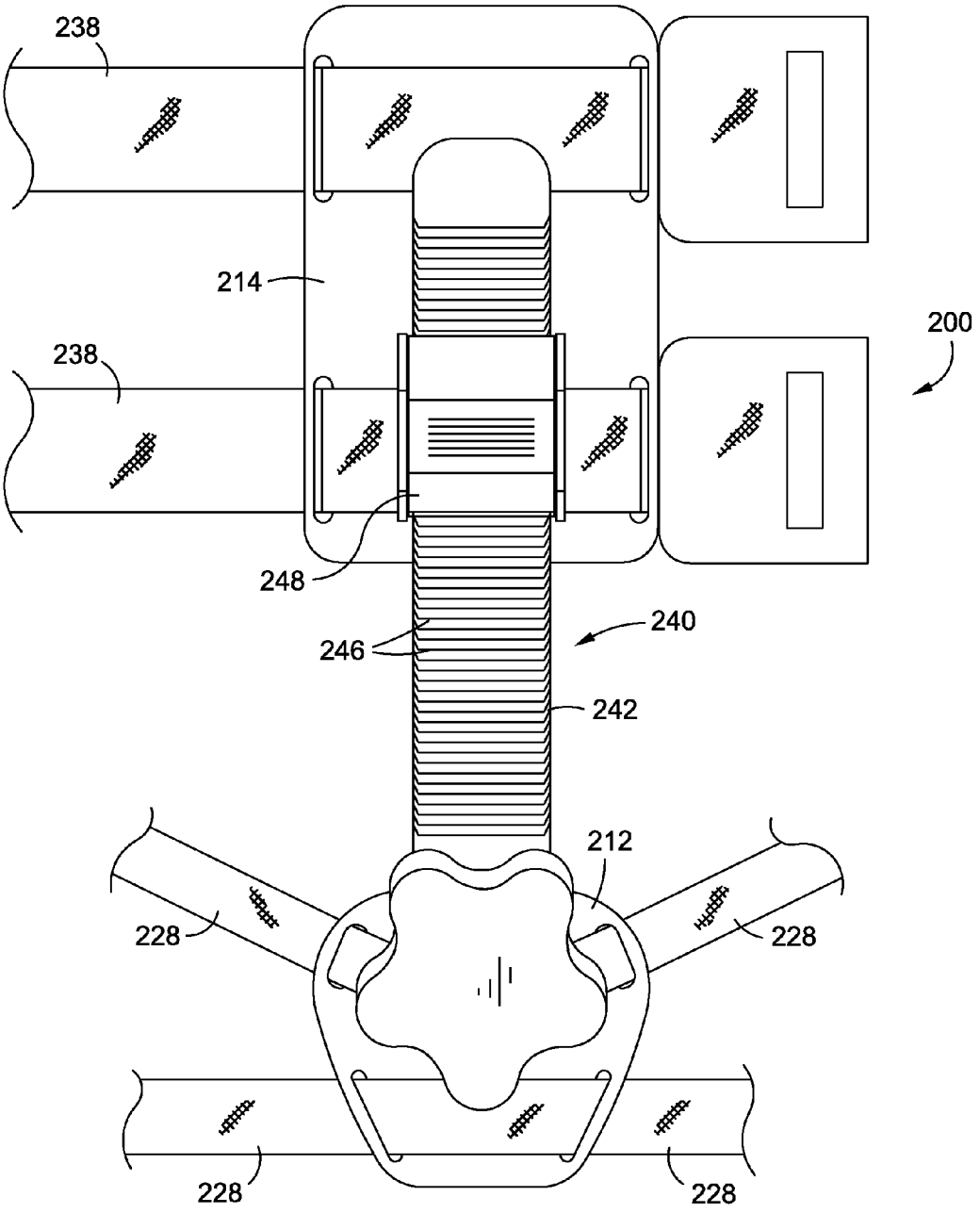
FIG. 11 is an enlargement of the hinge portion of the training device of the third embodiment shown in FIG. 10.
Figure 12:
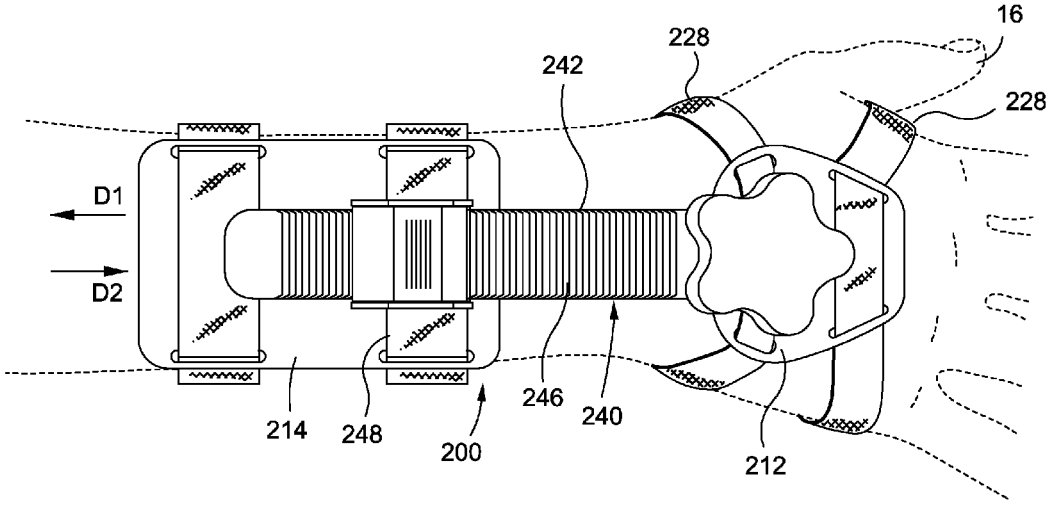
FIG. 12 is a top plan view of the training device of the third embodiment as operatively positioned on the right arm of a user, depicting the training device in a first, flat condition.
Figure 13:
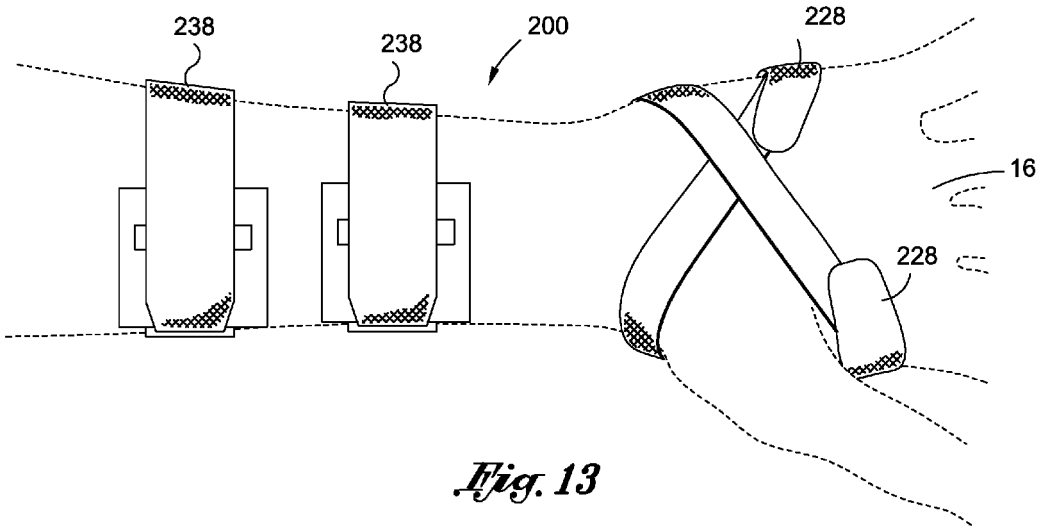
FIG. 13 is a bottom plan view of the training device of the third embodiment as operatively positioned on the right arm of a user, depicting the training device in its flat condition.
Figure 14:
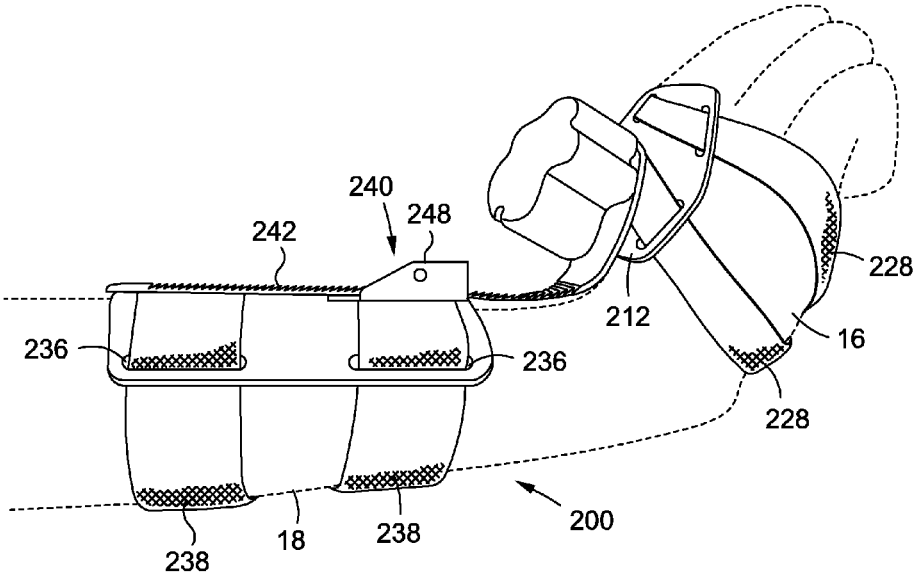
FIG. 14 is a side-elevational view of the training device of the third embodiment as operatively positioned on the right arm of a user, depicting the training device in its second, bent condition.

Referring now to FIGS. 10-15, there is shown a golf swing training device 200 constructed in accordance with a third embodiment of the present invention. The training device 200 of the third embodiment comprises a hand plate 212 and a forearm plate 214 which are operatively coupled to each other in a manner which will be described in more detail below. As best seen in FIGS. 12 and 14, the hand plate 212 of the training device 200 is configured to be positionable upon the posterior surface of the right hand 16 of the user, the posterior surface of the right hand 16 being that surface which is opposite the anterior or palmer surface of the right hand 16. The forearm plate 214 is itself adapted to be positionable upon the posterior surface of the right forearm 18 of the user. In this regard, both the hand plate 212 and forearm plate 214, when operatively positioned upon the right arm of the user, are each adapted to terminate in close proximity to the right wrist of the user.

In the training device 200, the hand plate 212 includes two opposed pairs of slots or apertures 226 therein. The apertures 226 are used to facilitate the interface or engagement of a pair of elongate retention straps 228 of the training device 200 to the hand plate 212. As most easily seen in FIGS. 13-15, the retention straps 228 are extensible diagonally or in a crisscross pattern about the anterior or palmer surface of the right hand 16 of the user and, when tightened, are operative to maintain the hand plate 212 in firm, abutting contact with the posterior surface of the right hand 16. Those of ordinary skill in the art will recognize that modalities other than for the retention straps 228 may be used for maintaining firm, abutting contact between the hand plate 212 and the posterior surface of the right hand 16 of the user. By way of example, it is contemplated that the hand plate 212 may be outfitted with one or more ring-like projections which are extensible about one or more of the index, middle and ring fingers of the right hand of the wearer. It is also contemplated that a single retention strap 228 may used in lieu of the two retention straps 228 described above.

Similar to the hand plate 212, the forearm plate 214 of the training device 200 is preferably formed to define two opposed pairs of slots or apertures 236 therein. In this regard, the apertures 236 of each of pair are disposed adjacent to and extend along respective ones of an opposed pair of longitudinally extending peripheral edge segments defined by the forearm plate 214. The apertures 236 of each opposed pair are used to facilitate the interface or engagement of respective ones of a pair of elongate retention straps 238 to the forearm plate 214. As also seen in FIGS. 13 and 14, the retention straps 238 are sized and configured to be extensible about the right forearm 18 of the user such that, when properly tightened, they function to maintain the forearm plate 214 in firm, abutting contact with the posterior surface of the right forearm 18. Those of ordinary skill in the art will recognize that the use of the retention straps 238 as a modality to maintain the firm engagement between the forearm plate 214 and the right forearm 18 of the user is exemplary only, and that the use of alternative structures to facilitate such engagement is contemplated to be within the spirit and scope of the present invention. By way of example and not by way of limitation, it is contemplated that the forearm plate 214 may be outfitted with, or at least partially integrated into, an elastic, sleeve-like structure which is extensible over and frictionally engageable to the right forearm 16 of the user.

The training device 200 of the third embodiment further comprises a wrist condition retention assembly 240 which is attached to and effectively interconnects the hand and forearm plates 212, 214 to each other. The retention assembly 240 comprises an elongate ratchet strap 242, one end of which is attached to the hand plate 212. More particularly, as best seen in FIGS. 12 and 14, the attachment of one end of the ratchet strap 242 to the hand plate 212 is facilitated by an attachment knob 244. However, those of ordinary skill in the art will recognize that mechanical structures other than for the attachment knob 244 may be used to facilitate the attachment of the ratchet strap 242 to the hand plate 212 without departing from the spirit and scope of the present invention. As is most apparent from FIGS. 11, 12 and 15, the ratchet strap 242 is formed to include a multiplicity of serrations or teeth 246 along the majority of the length thereof.

Figure 15:
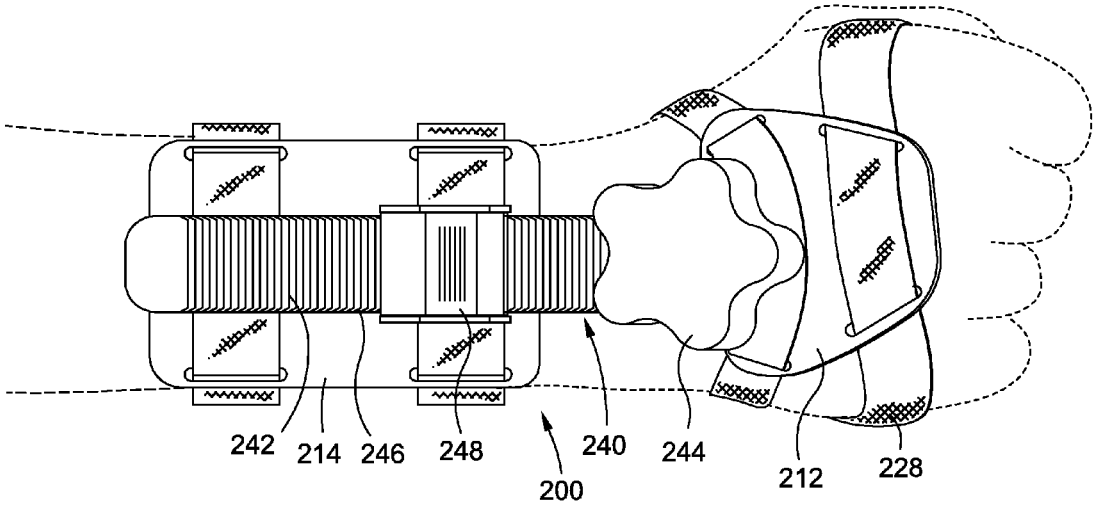
FIG. 15 is a top plan view of the training device of the third embodiment as operatively positioned on the right arm of a user, depicting the training device in its bent condition.

In addition to the ratchet strap 242, the retention assembly 240 includes a locking mechanism 248 which is attached to the forearm plate 214 and releasably engageable to the ratchet strap 242. As seen in FIGS. 11, 12 and 15, the ratchet strap 242 is advanceable through the locking mechanism 248. When viewed from the perspective shown in FIGS. 12 and 14, the locking mechanism 248 allows for the free passage and movement of the ratchet strap 242 therethrough in the direction shown by the arrow D1 in FIG. 12, but normally prevents the movement of the ratchet strap 242 therethrough in the direction shown by the arrow D2 which is opposite the direction D1. In this regard, in the retention assembly 240, the movement of the ratchet strap 242 in the direction D2 is normally prevented by the engagement of the locking mechanism 248 to a corresponding one of the teeth 246 defined by the ratchet strap 242. However, the movement of the ratchet strap 242 in the direction D2 is made possible by the application of compressive pressure to a prescribed, spring biased portion of the locking mechanism 248, such application of compressive pressure causing the locking mechanism 248 to effectively disengage the teeth 246 of the ratchet strap 242 as permits movement in the direction D2. However, once the application of compressive pressure thereto is discontinued, the locking mechanism 248 effectively re-engages at least one the teeth 246 of the ratchet strap 242 in a manner again preventing movement thereof in the direction D2. Those of ordinary skill in the art will recognize that the structural and functional attributes of the retention assembly 240 mirror, in large measure, the structural and functional attributes of ratcheting retention systems included on devices such as ski boot and snowboard boot bindings.

Having thus described the structural features of the training device 200 constructed in accordance with the third embodiment of the present invention, one exemplary manner of using the same will now be described with specific reference to FIGS. 12 and 14. In use of the training device 200, it is contemplated that such training device 200 will assume a first, generally flat or slightly bent state or condition as shown in FIG. 12 when the user addresses the golf ball and is ready to initiate the golf swing. Whereas the right wrist of the user is capable of moving from a flat condition to a state of extension since the ratchet strap 242 is free to move in the direction D1, the training device 200 normally prevents the right wrist of the user from moving to a state of flexion. More particularly, the movement of the right wrist to a flexed condition is prevented by the retention assembly 240, and in particular the engagement of the locking mechanism 248 to the ratchet strap 242 which prevents movement of the ratchet strap 242 in the direction D2 as would be needed to allow the right wrist of the user to be transitioned from the flat condition shown in FIG. 12 to such flexed condition. Conversely, since the retention assembly 240 normally allows movement of the ratchet strap 242 in the direction D1, the right wrist of the user is capable of transitioning from the flat condition shown in FIG. 12 to an extended condition as shown in FIG. 14. However, once the right wrist of the user reaches any state of extension such as that shown in FIG. 14, any movement of the right wrist back toward the flattened state is prevented by the retention assembly 240, and in particular the engagement of the locking mechanism 248 to a corresponding one of the teeth 246 of the ratchet strap 242.

As indicated above, when the user addresses the golf ball and is about to initiate golf swing, the right wrist will typically be in the generally flat or slightly bent state or condition shown in FIG. 12. As the user begins the back swing, the training device 200 permits the movement of the user's right wrist to any one of a multiplicity of differing degrees of extension, with the level of maximum extension or bend of the right wrist typically occurring at the top of the backswing. The level of extension or bend in the right wrist at the top of the backswing typically represents the bent right wrist condition which should be maintained through the entirety of the downswing, golf ball impact, and follow-through of the golf swing. As previously explained, the interaction between the locking mechanism 248 and ratchet strap 242 of the retention assembly 240 effectively maintains the state of extension or the bent wrist condition of the right wrist of the user at the top of the backswing, and prevents the right wrist from any movement back toward a flattened state or condition until such time as the locking mechanism 248 is manipulated in the aforementioned manner by the application of compressive pressure to a portion thereof. Along these lines, after the completion of a golf swing while wearing the training device 200, the user will "reset" the device 200 by manipulating the locking mechanism 248 in a manner which allows the right wrist to be returned to the original flat condition.

In the training device 200, it is contemplated that the hand and forearm plates 212, 214 may be fabricated from various materials (e.g., metals, plastics, etc.) in any combination. However, one preferred material for the hand and forearm plates 212, 214 is a carbon fiber composite or laminate which is both lightweight and durable. Irrespective of the material(s) used for the hand and forearm plates 212, 214, it is also contemplated that those surfaces thereof coming into direct contact with the right hand 16 and right forearm 18 of the user may have a suitable padded or cushioning layer applied thereto for greater wearer comfort. Moreover, it is contemplated that the hand plate 212, alone or in combination with the forearm plate 214, may be integrated into a glove which is worn by the user, thus potentially eliminating the need for some or all of the retention straps 228, 238.

The training devices 10, 100, 200 described above each allow the wearer/user to bend the right wrist back naturally from its normally flat or slightly bent condition at address, and at different amounts so as to represent the different amounts of right wrist bend a golfer may employ for shorter and longer strokes. Once the right wrist has achieved its full amount of bend or extension at the top of the backswing, the training devices 10, 100, 200 each effectively maintain such bend throughout the entirety of the downswing and follow-through or finish of the golf swing. Importantly, due to the structural features thereof, the retention assemblies 40, 240 and ratchet mechanism 134 each make an audible clicking sound during the backswing of the golf stroke which provides the user with an audible cue that the right wrist is achieving a bent, extended condition. In the retention assemblies 40, 240, the clicking sound is attributable to the engagement of the locking mechanisms 48, 248 to the teeth 46, 246 of the ratchet straps 42, 242. In the ratchet mechanism 134, the clicking sound is attributable to the internal structural features or components thereof.

Referring now to FIGS. 18-26, there is shown a golf swing training device 300 constructed in accordance with a fourth embodiment of the present invention. The training device 300 of the fourth embodiment as described below will also be discussed in terms of use by a right handed golfer, and thus configured for interface to the right arm of the wearer or user thereof. However, those of ordinary skill in the art will recognize that for a left-handed golfer, the structural and functional attributes of the training device 300 would be substantially identical to but presented as a mirror image of that version particularly suited to a right-handed golfer. Along these lines, it is contemplated that the modification of the training device 300 as described below to accommodate a left-handed golfer is within the spirit and scope of the present invention.

Figure 26:
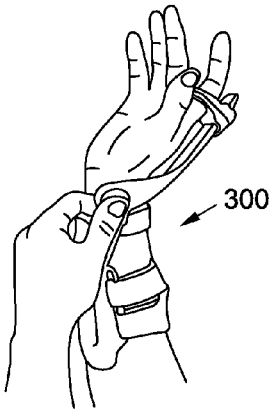
Figure 27:
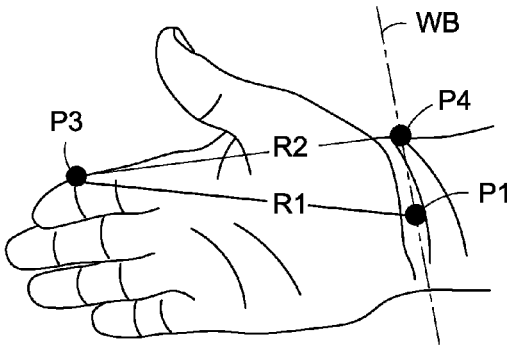
FIGS. 27-28 are side views of a user's hand providing visual illustrations regarding the basis for the functionality of a finger member of the training device of the fourth embodiment as allows it to slide on the right index finger of the user to accommodate differing radius lengths as the user's right wrist uncocks during use of the training device.

For purposes of the detailed description of the training device 300 as set forth below, assuming an initial frame of reference wherein the right hand of the user of training device 300 is held in approximately a traditional hand-shake position (as shown in FIG. 27) with the posterior surfaces of the hand and forearm generally aligned with each other, the thumb towards the sky, the heel of the hand towards the ground, and the fingers generally parallel to the ground, the term "wrist bend" used below is meant to refer the motion of the user's wrist bending or rotating to the left or right about a vertical wrist bend axis through the wrist joint which is generally normal to the ground as allows the fingers to stay generally parallel to the ground as the wrist bends. In FIG. 27, this wrist bend axis is roughly approximated by the axis WB labeled therein. Further, as viewed from the perspective shown in FIGS. 21-26, the term "wrist extension" refers to wrist bend in a clockwise direction from the generally flat relative positions between the hand and forearm shown in FIGS. 16, 19 and 23 to the angled orientation shown in FIGS. 20, 25 and 26, with the term "wrist flexion" referring to wrist bend in an opposite, counter-clockwise direction.

Figure 16:
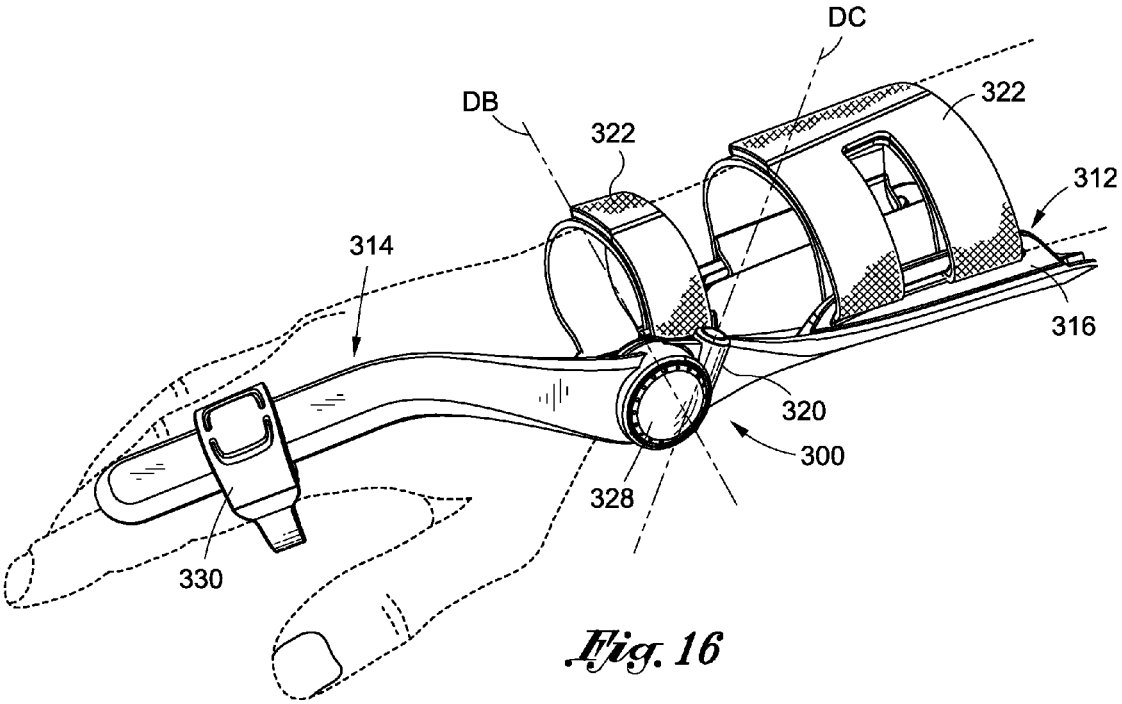
FIG. 16 is a top perspective view of a golf swing training device constructed in accordance with a fourth embodiment of the present invention, the training device being shown in a first, flat state or condition and operatively positioned on the right arm of a user.
Figure 17:
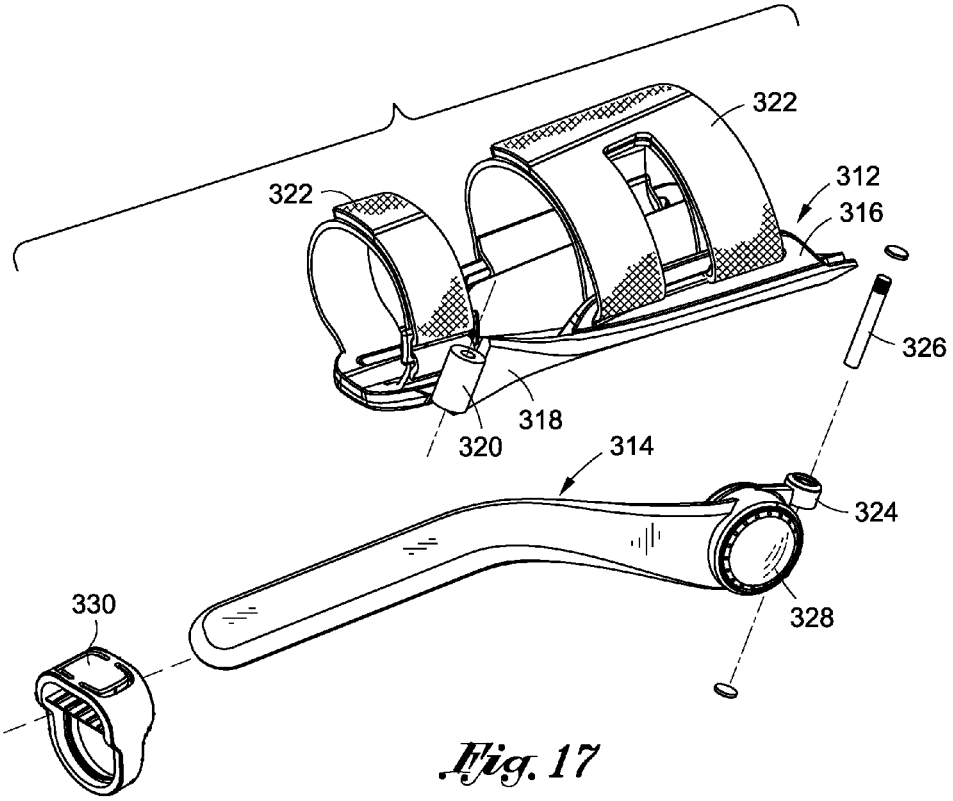
FIG. 17 is an exploded view of the training device of the fourth embodiment shown in FIG. 16.
Figure 19:
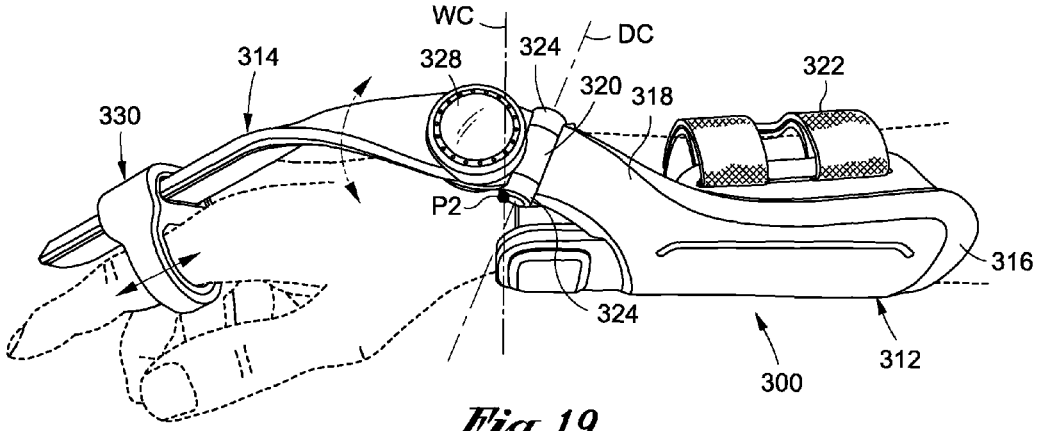
FIG. 19 is a side-elevational view of the training device of the fourth embodiment as operatively positioned on the right arm of a user, depicting the training device in a flat condition.
Figure 23:
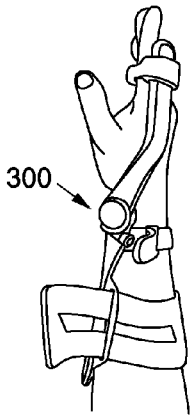
Figure 24:
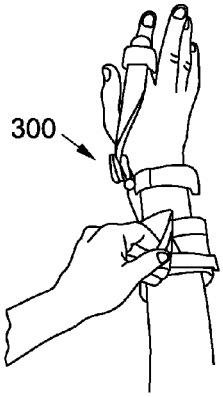

Using the same initial frame of reference shown in FIG. 27, the term "wrist cock" used below is meant to refer the motion of the user's wrist bending or rotating about a horizontal wrist cock axis through the wrist joint which is generally parallel to the ground as allows the fingers to move up and down relative to the ground as the wrist cocks. In FIG. 27 as well as FIG. 28, this wrist cock axis would axially project approximately through the point P1 shown therein, thus extending in generally perpendicular relation to the wrist bend axis WB. This wrist cock axis is also roughly approximated by the axis WC labeled in FIG. 19. Further, as viewed from the perspective shown in FIGS. 27 and 28, any reference to the wrist "uncocking" is intended to correspond to wrist cock in a counter-clockwise direction toward the ground as exemplified by the showing in FIG. 28, with any reference to the wrist "cocking" being intended to correspond to wrist cock in the opposite, clockwise direction. Based on the foregoing, and in the context of the detailed description which follows, the term "neutral position" will refer to a position of the wrist approximating what is shown in FIGS. 16, 19 and 23 wherein the right wrist is generally in the flat orientation with the posterior surfaces of the hand and forearm being generally aligned with each other such that there is little or no wrist bend (i.e., wrist extension or flexion), and further such that there is little or no wrist cock (i.e., cocking or uncocking of the wrist).

The training device 300 of the fourth embodiment comprises a forearm member or plate 312 and an elongate hand member or guide 314 which are pivotally connected to each other. As will be discussed in more detail below, the pivotal connection of the forearm plate 312 and the hand guide 314 to each other is adapted to facilitate the selective pivotal movement of the hand guide 314 relative to the forearm plate 312 about both a device bend axis DB which is shown and labeled in FIG. 16, and a device cock axis DC which is shown and labeled in FIGS. 16 and 18-20.

Figure 20:
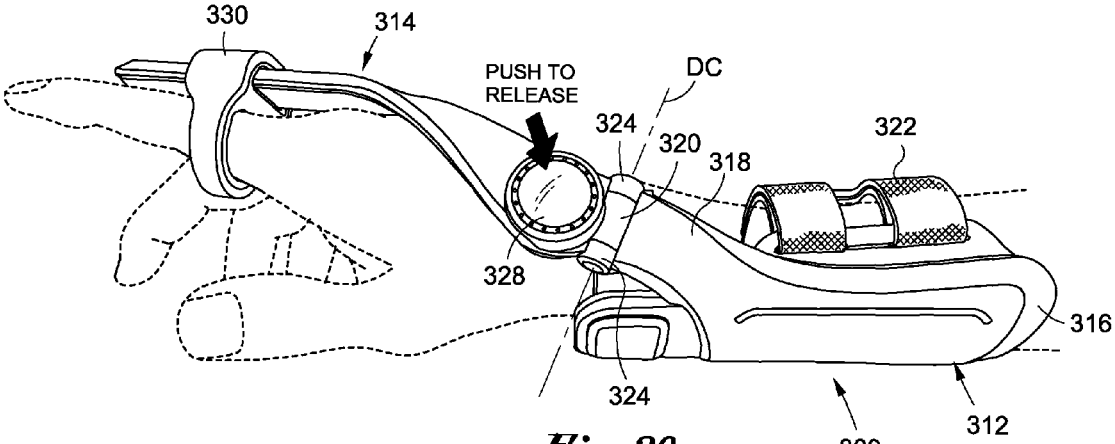
FIG. 20 is a side-elevational view of the training device of the fourth embodiment as operatively positioned on the right arm of a user, depicting the training device in a bent condition.
Figure 21:
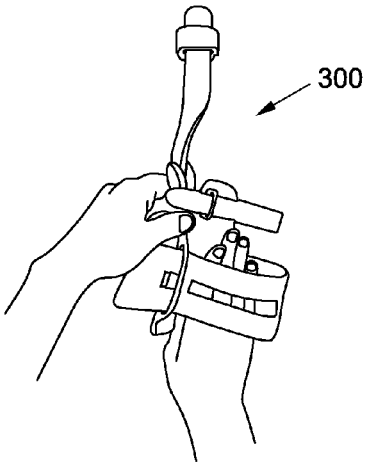
FIGS. 21-26 are top views depicting an exemplary sequence of steps for facilitating the operative interface of the training device of the fourth embodiment to the right arm of a user, and the use thereof for a practice golf swing.

In greater detail, the forearm plate 312 is adapted to be positionable upon the anterior surface of the right forearm of the user. In this regard, the forearm plate 312, when operatively positioned upon the right arm of the user, is configured to terminate at approximately the right wrist of the user. The forearm plate 312 comprises an arcuately contoured main body portion 316, the inner surface of which is preferably provided with a padding layer 317 thereon which directly contacts or engages the anterior surface of the user's forearm. As seen in FIGS. 17-20, in addition to the main body portion 316, the forearm plate 312 includes a prong portion 318 which is integrally connected to and protrudes angularly from one of the opposed longitudinally extending peripheral side edge segments defined by the main body portion 316. More particularly, when the forearm plate 312 is operatively positioned on the right forearm of the user as shown in FIGS. 19 and 20, the prong portion 318 protrudes from that longitudinally extending side edge segment of the main body portion 316 which is generally aligned with the user's right hand thumb. Integrally formed on the distal end of the prong portion 318 is a tubular, cylindrically configured attachment hub 320, the use of which will be described in more detail below. In the training device 300, it is contemplated that the forearm plate 312 may be fabricated from various materials (e.g., metals, plastics, etc.) in any combination. However, one preferred material for the forearm plate 312 is a carbon fiber composite or laminate which is both lightweight and durable.

In addition to the foregoing, the forearm plate 312 is preferably formed to define two opposed pairs of elongate slots therein. In this regard, the slots of each pair are disposed adjacent to and extend along respective ones of the opposed, longitudinally extending peripheral side edge segments defined by the main body portion 316. The slots of each pair are used to facilitate the interface or engagement of respective ones of a pair of elongate retention straps 322 to the forearm plate 312. As is best seen in FIG. 16, the retention straps 322 are sized and configured to be extensible about the right forearm of the user such that, when properly tightened, they function to maintain the main body portion 316 of the forearm plate 312 in firm, abutting contact with the anterior surface of the right forearm. Those of ordinary skill in the art will recognize that use of the retention straps 322 as a modality to maintain the firm engagement between the forearm plate 312 and the right forearm of the user is exemplary only, and that the use of alternative structures to facilitate such engagement is contemplated to be within the spirit and scope of the present invention. By way of example and not by way of limitation, it is contemplated that the forearm plate 312 may be outfitted with, or at least partially integrated into an elastic, sleeve-like like structure which is extensible over and firmly engageable to the right forearm of the user.

As seen in FIGS. 16-20, the hand guide 314 of the training device 300 is uniquely contoured to include a slight bend or "twist" formed therein. Based on its resultant structural attributes, when the hand guide 314 is pivotally connected to the forearm plate 312 in a manner which will be described in more detail below and the training device 300 is properly positioned on the user's hand and forearm, one end portion of the hand guide 314 is generally aligned with what is commonly referred to as the anatomical "snuffbox" of the right wrist. Along these lines, the twist formed into the hand guide 314 creates a transition which results in the opposite end portion extending along the posterior surface of the right index finger of the user, as is most easily seen in FIGS. 16, 19 and 20.

In the training device 300, that end of the hand guide 314 proximate the user's wrist when the training device 300 is worn by the user is formed to include a spaced, coaxially aligned pair of annular attachment hubs 324 thereon. The spacing between the attachment hubs 324 is selected so as to allow for the positioning of the attachment hub 320 therebetween such that the central apertures defined by the attachment hubs 324 are coaxially aligned with the elongate central aperture defined by the attachment hub 320. In this regard, as is apparent from FIG. 17, the coaxially aligned apertures of the attachment hubs 320, 324 are adapted to receive or accommodate an elongate pivot pin 326. The advancement of the pivot pin 326 into these coaxially aligned apertures facilitates the pivotal connection of the hand guide 314 to the forearm plate 312, with the attachment hubs 320, 324 and pivot pin 326 collectively defining a "device cock hinge" of the training device 300 which allows for the pivotal or rotational movement of the hand guide 314 relative to the forearm plate 312 about the device cock axis DC which is defined by the pivot pin 326.

Integrated into the hand guide 314 immediately adjacent the attachment hubs 324 thereof is a circularly configured ratchet mechanism 328. With the hand guide 314 being pivotally connected to the forearm plate 312 via the pivot pin 326 as completes the formation of the device cock hinge, the ratchet mechanism 328 integrated into the hand guide 314 defines a "device ratchet hinge" which allows for the pivotal or rotational movement of the hand guide 314 relative to the forearm plate 312 about the device bend axis DB which is defined by and extends axially through the ratchet mechanism 328.

The training device 300 further comprises a finger slide 330 which is configured to be advanced over the right index finger of the user in the manner shown in FIGS. 16, 19 and 20. The finger slide 330 is further slidably engageable to and reciprocally movable along that portion of the hand guide 314 which extends along the posterior surface of the right index finger in the manner depicted by the directional arrow included in FIG. 19. Whereas the finger slide 330 is intended to be maintained in fixed relation to the user's right index finger when operatively positioned thereon, it is intended to freely move along the hand guide 314 during normal operation of the training device 300 for reasons which will also be described in more detail below.

Figure 22:
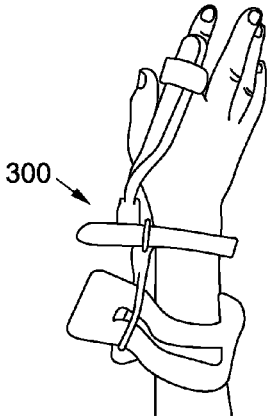

FIGS. 21-24 depict an exemplary sequence of steps for operatively interfacing the training device 300 to the right forearm and hand of the user. In the initial step and of the interface shown in FIG. 21, the user's right hand is advanced through the loosened retention straps 322 to facilitate the positioning of the forearm plate 312 upon the anterior surface of the right forearm. As seen in FIG. 22, the right index finger of the user is then advanced into the finger slide 330 which is sized and configured to be frictionally maintainable upon that portion of the index finger between the knuckle and the distal interphalangeal (IP) joint, and most preferably between the knuckle and the proximal IP joint. At the same time, as seen in FIG. 23, the ratchet mechanism 328 is positioned such that the device bend axis DB defined thereby is generally aligned with and extends through the aforementioned snuffbox of the right wrist. The retention straps 322 are then tightened in the manner shown in FIG. 24, thus maintaining the training device 300 on the user's hand and forearm in the orientation shown in FIG. 19.

It should be noted that in accordance with an exemplary embodiment of the present invention, when the training device 300 is operatively interfaced to the user in the proper manner as shown in FIG. 19 and the right wrist is in the aforementioned neutral position (with little or no wrist extension or flexion, and little or no cocking of uncocking of the wrist), the device cock axis DC and what is described above as the wrist cock axis WC extending axially through point P1 of the wrist joint extend in spaced relation to each other and are preferably not parallel (though the wrist cock hinge may be configured to define such a parallel relationship). In this regard, for reasons which will also be discussed in more detail below, when the user's wrist in the neutral position, it is contemplated that such wrist cock axis WC and the device cock axis DC may represent skew lines as they are not parallel and further may not intersect each other.

Figure 18:
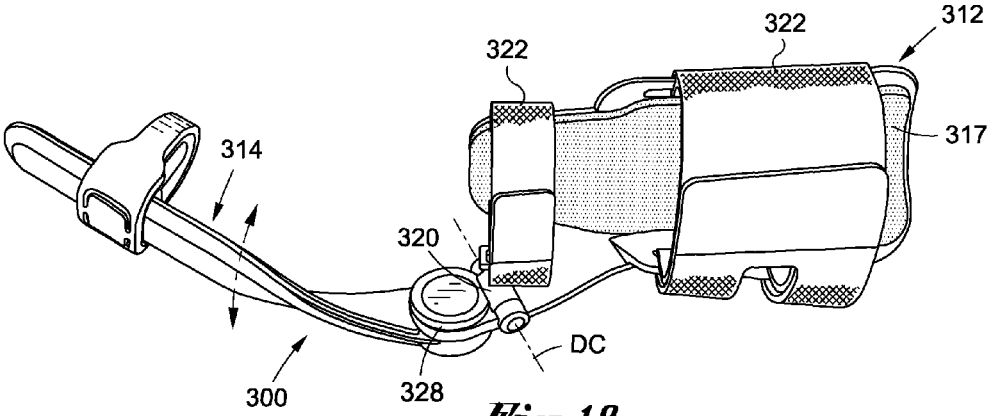
FIG. 18 is a top, slightly tilted view of the training device of the fourth embodiment of the present invention.

As is most apparent from FIGS. 18, 19 and 20, it should further be noted that in accordance with an exemplary embodiment of the present invention, when the right wrist is in the neutral position as shown in FIG. 19, with little or no wrist extension or flexion and little or no cocking of uncocking of the wrist, the device bend axis DB is slightly angularly offset from what is described above as the wrist bend axis WB. In this regard, when viewed from the perspective shown in FIG. 19, it is contemplated that such wrist bend axis WB would axially project approximately through the point P2 shown in FIG. 19, thus extending in non-parallel relation to the device bend axis DB defined by the ratchet mechanism 328.

In the training device 300, the ratchet mechanism 328 effectively functions as a wrist condition retention device. When viewed from the perspective shown in FIGS. 19-26, the ratchet mechanism 328 allows for the pivotal or rotatable movement of the hand guide 314 relative to the forearm plate 312 about the device bend axis DB in a clockwise direction, but normally prevents the pivotal or rotatable movement of the hand guide 314 relative to the forearm plate 312 about the device bend axis DB in a counter-clockwise direction. Thus, when the training device 300 is properly positioned upon the user, with the user's wrist initially residing in the neutral position shown in FIGS. 16, 19 and 23 as described above, the ratchet mechanism 328, by virtue of allowing for the movement of the hand guide 314 relative to the forearm plate 312 about the device bend axis DB in a clockwise direction, accommodates the extension of the wrist attributable to its movement from the neutral position about the wrist bend axis WB as results in the posterior surface of the hand moving toward the posterior surface of the forearm. Moreover, in view of the slight angular offset between the device bend axis DB and the wrist bend axis WB, the device ratchet hinge defined by the ratchet mechanism 328 also effectively allows for some measure of the cocking of the wrist about the wrist cock axis WC as the wrist transitions from its neutral position to a state of extension. Stated another way, as the wrist ratchets back bending into a state of extension from its neutral position, it is simultaneously permitted to undergo some measure of cocking.

Figure 25:
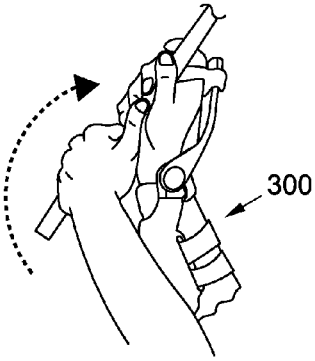

Referring now to FIGS. 25 and 26, in exemplary use of the training device 300 for golf swing training, when maximum wrist extension (and presumably some measure of wrist cocking) is achieved at, for example, the top of the back swing portion of a practice swing, the wrist is essentially locked or maintained in its extended state as shown in FIGS. 20 and 25. In this regard, the ratchet mechanism 328 is operative to prevent rotation of the hand guide 314 about the device bend axis DB in a counter-clockwise direction relative to the forearm plate as viewed from the perspective shown in FIGS. 20 and 25, thus in turn preventing any rotation of the wrist about the wrist bend axis WB into a state of flexion wherein the posterior surface of the hand is moving away from the posterior surface of the forearm.

The ratchet mechanism 328 will also function to resist any uncocking of the wrist from the cocked state (relative to its its neutral position) that it may assume at the top of the back swing portion of a practice swing. However, in order for a proper down swing to occur as part of the practice swing with a user wearing the training device 300, the uncocking of the wrist is desirable, though the movement of the wrist from its state of extension to a state of flexion is not, and is indeed the type of movement the training device 300 is intended to prevent, consistent to the description above corresponding to the first three embodiments of the present invention. In this regard, during the down swing portion of the practice swing, the device cock hinge predominately defined by the pivot pin 326 allows for the rotation of the hand guide 314 relative to the forearm plate 312 about the device cock axis DC in a clockwise direction as viewed from the perspective shown in FIG. 16, which in turn allows for the uncocking of the user's wrist about the aforementioned wrist cock axis WC.

Importantly, when the training device 300 is worn by the user and the wrist is in its neutral position as shown in FIGS. 16, 19 and 23, the device cock hinge generally resists the cocking of the wrist, such resistance being attributable to the above-described non-parallel relationship between the wrist cock axis WC and the device cock axis DC. However, bending or transitioning the wrist into a state of extension facilities the shift of the wrist cock axis WC into a generally parallel relationship with the device cock axis DC as allows the device cock hinge to accommodate the uncocking of the user's wrist. As seen in FIG. 26, the ratchet mechanism 328 is outfitted with a release switch which, when selectively actuated by the user, allows for the pivotal or rotatable movement of the hand guide 314 relative to the forearm plate 312 about the device bend axis DB in a counter-clockwise direction as needed to allow for the return of the wrist from its state of extension into flexion and back to its neutral position in anticipation of another practice swing. Those of ordinary skill in the art will recognize that the structural and functional attributes of the ratchet mechanism 328 mirror, in large measure, the structural and functional attributes of conventional ratchet tools.

As indicated above, when the user addresses the golf ball and is about to initiate a practice golf swing, the right wrist will typically be in the generally flat or slightly bent state or condition shown in FIGS. 19 and 20. As the user begins the back swing, the training device 300 permits the movement of the user's right wrist to any one of a multiplicity of differing degrees of extension, as well as cocking, with the level of maximum extension and cocking of the right wrist typically occurring at the top of the backswing. The level of extension in the right wrist at the top of the backswing typically represents the bent right wrist condition which should be maintained through the entirety of the downswing, golf ball impact, and follow-through of the golf swing. As previously explained, the ratchet mechanism 328 of the training device 300 effectively maintains the state of extension or the bent wrist condition of the right wrist of the user at the top of the backswing, and prevents the right wrist from any movement in flexion back toward a the neutral position until such time as the release switch of the ratchet mechanism 328 is actuated by the user. Along these lines, after the completion of a practice golf swing while wearing the training device 300, the user will "reset" the device 300 by manipulating the release switch of the ratchet mechanism 328 in a manner which allows the right wrist to be returned to the neutral position.

Figure 28:
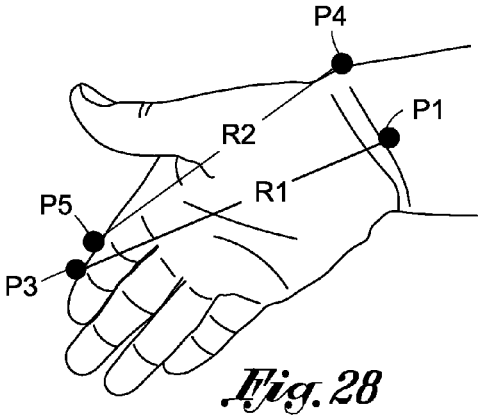

Referring now to FIGS. 27 and 28, the finger slide 330 performs a critical function in the operation of the training device 300, in that it effectively maintains the hand guide 314 in engagement to the user's right hand (via the right index finger), whereas the retentions straps 322 maintain the forearm plate 312 in engagement to the user's right forearm. The slidable attachment of the finger slide 330 to the hand guide 314 is needed to accommodate uncocking of the wrist as may occur during the down swing portion of a practice swing. In greater detail, as shown in FIG. 27, when the training device 300 is worn by the user and the wrist is in the neutral position, the wrist cock axis (extending axially though P1) is separated from an exemplary location point P3 of the finger slide 330 upon the hand guide 314 by a first distance R1. At the same time, a point P4 generally representative of the location of the device cock hinge is separated from the point P3 by a second distance R2. Whereas the uncocking of wrist in the manner shown in FIG. 28 does not significantly alter the first distance R1 between the points P1 and P3, it does result in the second distance R2 between shifted so as to be defined between points P4 and P5, as opposed to points P4 and P3, point P5 representing a new location of the finger slide 330 upon the hand guide 314. Thus, as apparent from the foregoing, the differences in R1 and R2 resulting from the uncocking of the wrist and its rotation about the wrist cock axis WC extending axially through point P1 is accommodated by the slidable attachment of the finger slide 330 to the hand guide 314.

This disclosure provides exemplary embodiments of the present invention. The scope of the present invention is not limited by this exemplary embodiment. Numerous variations, whether explicitly provided for by the specification or implied by the specification, such as variations in structure, dimension, type of material and manufacturing process may be implemented by one of skill in the art in view of this disclosure.

What is claimed is:

1. A golf swing wrist condition training device, comprising:

a hand guide attachable to the hand of a user;

a forearm member attachable to the forearm of the user, the hand guide being cooperatively engaged to the forearm member so as to be rotatable relative thereto about a device bend axis between a first state wherein the user's wrist when wearing the device is in a generally flat, neutral position, and a second state wherein the user's wrist when wearing the device is rotated about a wrist bend axis extending through the wrist into a condition of extension; and a retention assembly integrated into the device so as to be positioned along the device bend axis, the retention assembly being operative to maintain the user's wrist in the second state.

2. The training device of claim 1 wherein the retention assembly comprises a ratchet mechanism.

3. The training device of claim 1 wherein the retention assembly defines the device bend axis.

4. The training device of claim 3 wherein the retention assembly comprises a ratchet mechanism.

5. The training device of claim 4 wherein the ratchet mechanism is integrated into the hand guide.

6. The training device of claim 1 wherein the hand guide is further cooperatively engaged to the forearm member so as to be rotatable relative thereto about a device cock axis such that when the device is worn by the user and the user's wrist is in the second state, the user's wrist may rotate about a wrist cock axis also extending through the wrist through a condition of uncocking.

7. The training device of claim 6 wherein the device cock axis is defined by a pivot pin extending through and pivotally connecting prescribed portions of the hand guide and the forearm member to each other.

8. The training device of claim 6 wherein the hand guide is cooperatively engaged to the forearm member such that when the device is worn by the user and the user's wrist is in the neutral position, the device cock axis is offset relative to the wrist cock axis as mitigates against the rotation of the wrist about the wrist cock axis through a condition of cocking.

9. The training device of claim 1 wherein the hand guide is cooperatively engaged to the forearm member in a manner wherein the device bend axis is offset from the wrist bend axis such that during the rotation of the user's wrist about the wrist bend axis from the neutral position toward the condition of extension when the user is wearing the device, the user's wrist may concurrently rotate about a wrist cock axis also extending through the wrist through a condition of cocking, the user's wrist being in both the condition of extension and the condition of cocking in the second state.

10. The training device of claim 9 wherein the hand guide is further cooperatively engaged to the forearm member so as to be rotatable relative thereto about a device cock axis such that when the device is worn by the user and the user's wrist is in the second state, the user's wrist may rotate about the wrist cock axis through a condition of uncocking.

11. The training device of claim 10 wherein the device cock axis is defined by a pivot pin extending through and pivotally connecting prescribed portions of the hand guide and the forearm member to each other.

12. The training device of claim 10 wherein the hand guide is cooperatively engaged to the forearm member such that when the device is worn by the user and the user's wrist is in the neutral position, the device cock axis is offset relative to the wrist cock axis as mitigates against the rotation of the wrist about the wrist cock axis through a condition of cocking.

13. The training device of claim 10 wherein the hand guide is adapted to be attachable solely to the index finger on the hand of the user.

14. The training device of claim 13 wherein the hand guide is attached to the index finger via a finger slide which is sized and configured to be frictionally maintainable upon the index finger, and is slidably attached to the hand guide so as to be reciprocally movable along a portion thereof.

15. The training device of claim 14 further comprising a plurality of elongate retention straps which are cooperatively engaged to the forearm member and adapted to maintain the forearm member in firm engagement to a prescribed portion of the forearm of the user.

16. A golf swing wrist condition training device, comprising:

a hand guide attachable to the hand of a user;

a forearm member attachable to the forearm of the user, the hand guide being cooperatively engaged to the forearm member in a manner wherein:

the hand guide is rotatable relative to the forearm member about a device bend axis between a first state wherein the user's wrist when wearing the device is in a generally flat, neutral position and a second state wherein the user's wrist when wearing the device is rotated about a wrist bend axis extending through the wrist into a condition of extension;

the device bend axis is offset from the wrist bend axis such that during the rotation of the user's wrist about the wrist bend axis from the neutral position toward the condition of extension when the user is wearing the device, the user's wrist may concurrently rotate about a wrist cock axis also extending through the wrist through a condition of cocking, the user's wrist being in both the condition of extension and the condition of cocking in the second state; and the hand guide is further rotatable relative to the forearm member about a device cock axis wherein when the device is worn by the user and the user's wrist is in the second state, the user's wrist may rotate about the wrist cock axis through a condition of uncocking; and a retention assembly integrated into the device and being operative to maintain the user's wrist in the second state.

17. The training device of claim 16 wherein the retention assembly comprises a ratchet mechanism.

18. The training device of claim 17 wherein the ratchet mechanism defines the device bend axis.

19. The training device of claim 18 wherein the device cock axis is defined by a pivot pin extending through and pivotally connecting prescribed portions of the hand guide and the forearm member to each other.

20. The training device of claim 18 wherein the hand guide is cooperatively engaged to the forearm member such that when the device is worn by the user and the user's wrist is in the neutral position, the device cock axis is offset relative to the wrist cock axis as mitigates against the rotation of the wrist about the wrist cock axis through a condition of cocking.

* * * * *